United States Patent [19]

Ishikawa et al.

[11] Patent Number: 4,835,092

[45] Date of Patent: May 30, 1989

[54] METHOD FOR PROCESSING A SILVER HALIDE COLOR PHOTOGRAPHIC MATERIAL USING A COLOR DEVELOPER CONTAINING A CHELATING AGENT IN THE ABSENCE OF BENZYL ALCOHOL

[75] Inventors: Takatoshi Ishikawa; Toshio Koshimizu; Yoshihiro Fujita; Hiroshi Fujimoto, all of Kanagawa, Japan

[73] Assignee: Fuji Photo Film Co., Ltd., Kanagawa, Japan

[21] Appl. No.: 15,408

[22] Filed: Feb. 17, 1987

[30] Foreign Application Priority Data

Feb. 17, 1986 [JP] Japan ..... 61-32464

[51] Int. Cl.[4] ..... G03C 7/30; G03C 5/24

[52] U.S. Cl. ..... 430/380; 430/464; 430/467; 430/468; 430/372; 430/434; 430/442; 430/490; 430/491

[58] Field of Search ..... 430/380, 464, 467, 468, 430/372, 434, 442, 490, 491

[56] References Cited

U.S. PATENT DOCUMENTS

| | | | |
|---|---|---|---|
| 3,996,054 | 12/1976 | Santemma et al. | 430/377 |
| 4,035,188 | 7/1977 | Yabata et al. | 430/467 |
| 4,299,914 | 11/1981 | Fujumastu et al. | 430/552 |
| 4,304,844 | 12/1981 | Fujimatsu et al. | 430/552 |
| 4,443,536 | 4/1984 | Lestina | 430/552 |
| 4,482,626 | 11/1984 | Twist et al. | 430/380 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,562,777 | 1/1986 | Ogawa et al. | 430/552 |
| 4,564,590 | 1/1986 | Sasaki et al. | 430/552 |

FOREIGN PATENT DOCUMENTS

| | | | |
|---|---|---|---|
| 29461 | 8/1974 | Japan . | |
| 52058 | 4/1980 | Japan . | |
| 200037 | 12/1982 | Japan . | |
| 31334 | 2/1983 | Japan . | |
| 42045 | 3/1983 | Japan . | |
| 50536 | 3/1983 | Japan . | |
| 48755 | 3/1984 | Japan . | |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 26338 | 2/1985 | Japan . | |
| 26339 | 2/1985 | Japan . | |
| 158444 | 8/1985 | Japan . | |
| 162256 | 8/1985 | Japan . | |
| 158446 | 9/1985 | Japan | 430/464 |
| 172042 | 9/1985 | Japan . | |
| 70552 | 4/1986 | Japan . | |
| 30250 | 2/1987 | Japan . | |
| 211437 | 2/1987 | Japan . | |

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A novel method for processing a silver halide color photographic material is provided, which comprises processing a silver halide color photographic material having at least one silver halide emulsion layer on a reflective support with a color-developing solution substantially free of benzyl alcohol and containing at least one compound represented by formula (I)

(I)

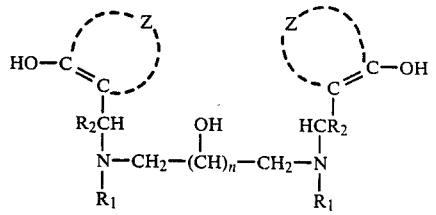

wherein $R_1$ represents a hydrogen atom, $—CH_2COOH$, or

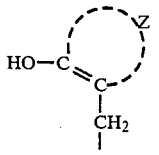

$R_2$ represents a hydrogen atom or —COOH; n represents an integer of 0 or 1; and Z represents atoms necessary for the formation of an aromatic ring.

12 Claims, No Drawings

METHOD FOR PROCESSING A SILVER HALIDE COLOR PHOTOGRAPHIC MATERIAL USING A COLOR DEVELOPER CONTAINING A CHELATING AGENT IN THE ABSENCE OF BENZYL ALCOHOL

FIELD OF THE INVENTION

The present invention relates to a method for processing a silver halide color photographic material, and more particularly the present invention relates to a method for processing which improves the stability of a color-developing solution and provides a shortened processing time.

BACKGROUND OF THE INVENTION

In recent years, it has been desired in the market of a color photographic material that the processing time be shortened in order to provide an earlier time of delivery, and to simplify the laboratory operation. Each processing step can be generally shortened by raising the processing temperature or increasing the amount of the processing solution to be replenished. Further, increasing agitation or incorporation of various accelerators have been proposed.

In a method for processing a color photographic material having a reflective support, shorter processing steps are used. In such processing steps, the processing is generally completed by bleach-fixing and rinsing steps after a color development step.

However, it has been found that when a light-sensitive material is continuously processed in such a short processing step, a new problem arises. That is, when the light-sensitive material is subjected to a bleach-fixing process for 1 minute or less and to a rinsing process for 2 minutes or less, staining of the light-sensitive material thus processed may become worse. This phenomenon is remarkable particularly when the water used is saved to an extent that the amount of the rinsing water is significantly decreased. Such a stain can be visually perceived on a reflective support, and hence it can be a problem in practical use.

Such a stain can be attributed to oxidized components of the color-developing solution which has remained on the light-sensitive material even after rinsing, because it has been found that such a stain can be removed by re-rinsing the material, and such a stain is not produced in the case of using a sufficient rinsing time and amount, or in he case of renewing the color-developing solution.

In order to improve the stability of a color-developing solution, various preservatives or chelating agents have heretofore been proposed. Examples of such preservatives include aromatic polyhydroxy compounds as described in Japanese Patent Application (OPI) Nos. 49828/77, 160142/84 and 47038/81 (the term "OPI" as used herein refers to a "published unexamined Japanese patent application") and U.S. Pat. No. 3,746,544, hydroxycarbonyl compounds as described in U.S. Pat. No. 3,615,503 and British Pat. No. 1,306,176, α-aminocarbonyl compounds as described in Japanese Patent Application (OPI) Nos. 143020/77 and 89425/78, alkanolamines as described in Japanese Patent Application (OPI) No. 3532/79, and metal salts as described in Japanese Patent Application (OPI) Nos. 44148/82 and 53749/82. And examples of such chelating agents include aminopolycarboxylic acids as described in Japanese Patent Publication Nos. 30496/73 and 30232/69, organic phosphonic acids as described in Japanese Patent Application (OPI) No. 97347/81, Japanese Patent Publication No. 39359/81 and West German Pat. No. 2,227,639, phosphonocarboxylic acids as described in Japanese Patent Application (OPI) Nos. 102726/77, 42730/78, 121127/79, 126241/80 and 65956/80, and compounds as described in Japanese Patent Application (OPI) Nos. 195845/83 and 203440/83 and Japanese Patent Publication No. 40900/78.

However, even if these compounds are added to a color-developing solution for a reflective light-sensitive material containing an ordinary benzyl alcohol, only some compounds can provide even a small effect. Thus, these compounds cannot fully avoid the production of a stain in a short processing time as described herein.

SUMMARY OF THE INVENTION

It is therefore an object of the present invention to provide a method for processing which provides a stable performance without producing a stain even in the case of using a short processing time.

The above and other objects of the present invention will become more apparent from the following description and examples.

The objects of the present invention are accomplished by a method for processing a silver halide color photographic material, which comprises processing a silver halide color photographic material having at least one silver halide emulsion layer on a reflective support with a color-developing solution substantially free of benzyl alcohol and containing at least one compound represented by formula (I)

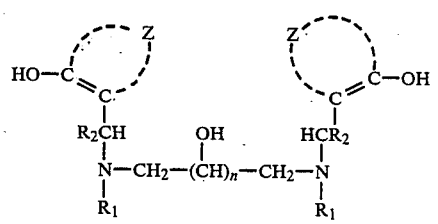

(I)

wherein $R_1$ represents a hydrogen atom, $-CH_2COOH$, or

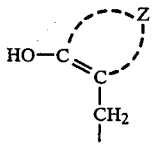

;

$R_2$ represents a hydrogen atom or —COOH; n represents an integer of 0 or 1; and Z represents atoms necessary for the formation of an aromatic ring.

The color-developing solution contains an aromatic primary amine color-developing agent. The silver halide color photographic material is subjected to bleach-fixing and then to rinsing after being color-developed. The bleach-fixing time is 1 minute or less, and the rinsing time is 2 minutes or less. The replenished amount of the rinsing solution per unit area of the silver halide color photographic material is from 0.1 to 50 times the amount of the solution which is carried from the preceding bath.

DETAILED DESCRIPTION OF THE INVENTION

Preferred among the above-described compounds of formula () are those having a structure represented by formula (II)

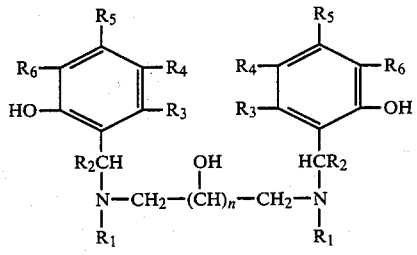

(II)

In formula (II), $R_1$ represents a hydrogen atom, —$CH_2$—COOH, or

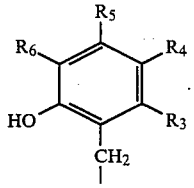

$R_2$ represents a hydrogen atom or —COOH.

$R_3$, $R_4$, $R_5$ and $R_6$ each represents —COOH, —$SO_3H$, a substituted or unsubstituted $C_{1-4}$ (i.e., containing from 1 to 4 carbon atoms) alkyl or alkoxy group (which is optionally substituted by —COOH, —$SO_3H$, or —OH group). $R_4$ may form a condensed benzene ring with $R_3$ or $R_5$. $R_6$ may form a condensed benzene ring with $R_5$.

In formula (II), n represents an integer of 0 or 1.

In formula (II), the two groups $R_1$ both are preferably —$CH_2$COOH. If $R_1$ is an alkyl or alkoxy group, it preferably has one or two carbon atoms, and may be optionally substituted by a —COOH or —OH group.

Examples of compounds of the above formulae which are preferably used in the present invention include those shown below.

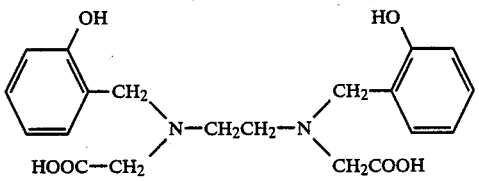

HBED

N,N'—bis(2-hydroxybenzyl)ethylenediamine-N,N'—diacetic acid

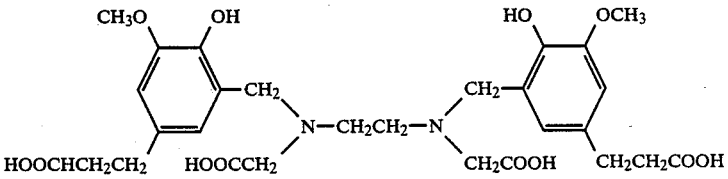

MPHBED

N,N'—bis[3-(2-carboxyethyl)-b-hydroxy-5-methoxybenzyl]ethylenediamine-N,N'—diacetic acid

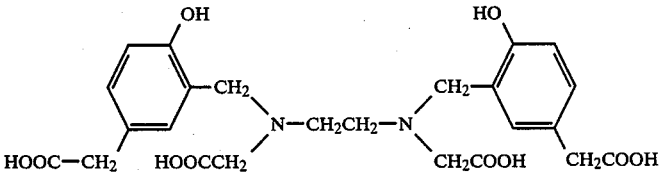

CHBED

N,N'—bis(3-carboxymethyl-6-hydroxybenzyl)ethylenediamine-N,N'—diacetic acid

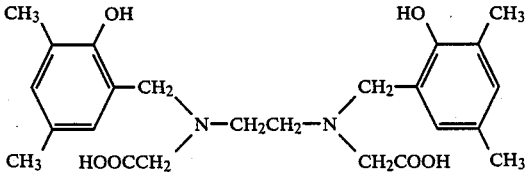

TMHBED

N,N'—bis(3,5-dimethyl-6-hydroxybenzyl)ethylenediamine-N,N'—diacetic acid

-continued

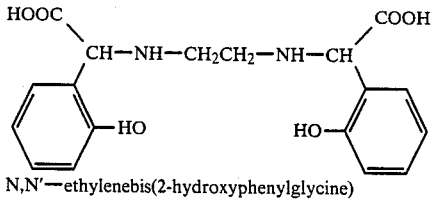

N,N'—ethylenebis(2-hydroxyphenylglycine) EHPG

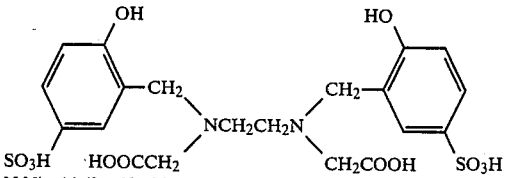

N,N'—bis(3-sulfo-6-hydroxybenzyl)ethylenediamine-N,N'—diacetic acid HBEDSO

Reference literature concerning synthesis of these polyamino compounds to be used in the present invention include U.S. Pat. Nos. 2,967,196, 3,632,637 and 3,758,540; Soviet Union Pat. No. 273,207 (CA7422532e); *Mem. Fac. Sci. Kyushu Univ. Ser.* C8(1)25-8 (1972)-CA 76-140123m; Mori et al., *Bull. Chem. Soc. Japan,* pp. 35 and 75–77 (1962); L. D. Tayler et al., *J. Org. Chem.,* Vol. 43, p. 1197 (1978); and F. L'Eplattenier, et al., *J.A.C.S.,* Vol. 88, p. 837 (1966).

Some of the compounds of formula (I) can be prepared by the Mannich reaction as shown below.

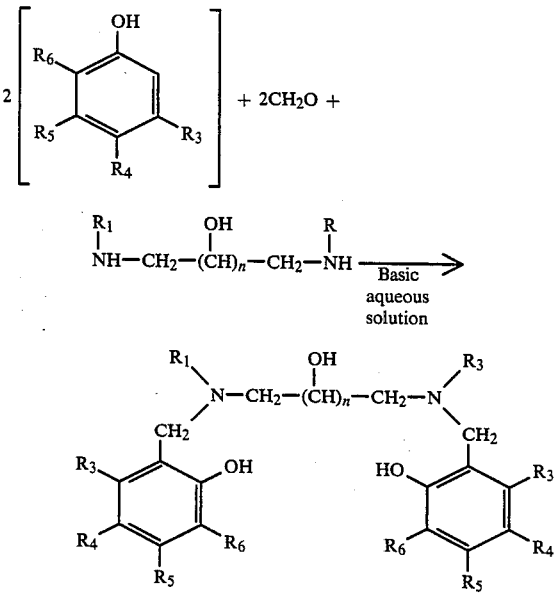

The compound wherein $R_2$ is —COOH can be prepared by the method described in *J.A.C.S.,* Vol. 79, pp. 2024–5 (1957).

Examples of process for the preparation of some compounds of formula (I) are described in U.S. Pat. No. 4,482,626. These compounds are adapted to be present in a color developing solution in an amount of from 0.1 to 10 g/liter, and preferably from 1 to 5 g/liter.

These compounds may be used in combination with other chelating agents in an amount of from 0.01 to 10 g/liter, and preferably from 0.1 to 1.0 g/liter.

It has been known that a color-developing solution comprising the compound of the present invention can be used for photographic processing. For example, such is described in Japanese Patent Application (OPI) No. 195845/83. However, it is impossible to fully inhibit an increase in stain produced in a processing comprising a short step after development ãs employed by the present invention merely using these compounds.

The inventors have found that such a stain is caused by the attachment of an oxidized component of a color-developing solution, and that benzyl alcohol, which is another component of the developing solution, takes part in the production of such an oxidized component or the attachment thereof.

Furthermore, it has been discovered by the inventors that the production of stain in the case of short processing can be effectively prevented by the combination of a developiing agent substantially free of benzyl alcohol and a compound of formula (I).

The color-developing agent to be used in the present invention comprises a known aromatic primary amine color-developing agent. A preferred example of such a color-developing agent is a p-phenylenediamine derivative. Typical examples of such a p-phenylenediamine derivative will be shown hereinafter, but the present invention should not be construed as being limited thereto.

D-1 N,N-Diethyl-p-phenylenediamine
D-2 2-Amino-5-diethylaminotoluene
D-3 2-Amino-5-(N-ethyl-N-laurylamino)toluene
D-4 4-[(N-Ethyl-N-(β-hydroxyethyl)amino]aniline
D-5 2-Methyl-4-[N-ethyl-N-(β-hydroxyethyl)amino]-aniline
D-6 N-Ethyl-N-(β-methanesulfonamidoethyl)-3-methyl-4-aminoaniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline These p-phenylenediamine derivatives may be salts such as sulfates, hydrochlorides, sulfites, and p-toluenesulfonates. The amount of such an aromatic primary amine developing agent to be used is from about 0.1 to about 20 g, and preferably from about 0.5 to about 10 g, per liter of developing solution.

The color-developing solution to be used in the present invention may further contain a hydroxylamine as a well-known component.

Such a hydroxylamine can be used in the form of a free amine in a color-developing solution. However, such a hydroxylamine is more generally used in the form of a water-soluble acid salt. Typical examples of such a salt include sulfates, oxalates, hydrochlorides, phosphates, carbonates, and acetates. Such a hydroxylamine may be either substituted or unsubstituted. Such a hydroxylamine may comprise nitrogen atoms substituted by alkyl groups.

The added amount of such a hydroxylamine is up to 10 g, preferably up to 5 g, per liter of color-developing solution. Provided that the color-developing solution can be kept stable, the added amount of such a hydroxylamine is preferably less.

The present color-developing solution preferably contains as a perservative a sulfite such as sodium sulfite, potassium sulfite, sodium bisulfite, potassium bisulfite, sodium metabisulfite, and potassium metabisulfite, or a carbonyl sulfite addition product. The added amount of such a perservative is generally up to 20 g/liter, and preferably up to 5 g/liter. Provided that the color-developing solution can be kept stable, the added amount of such a perservative is preferably less.

Other examples of preservatives which may be used in the present invention include aromatic polyhydroxy compounds as described in Japanese Patent Application (OPI) Nos. 49828/77, 47038/81, 32140/81 and 160142/84, and U.S. Pat. No. 3,746,544; hydroxyacetones as described in U.S. Pat. No. 3,615,503 and British Pat. No. 1,306,176; α-aminocarbonyl compounds described in Japanese Patent Application (OPI) Nos. 143020/77 and 89425/78; various metals as described in Japanese Patent Application (OPI) Nos. 44148/82 and 53749/82; various saccharides as described in Japanese Patent Application (OPI) No. 102727/77; hydroxam acids as described in Japanese Patent Appliction (OPI) No. 27638/77; α,α'-dicarbonyl compounds as described in Japanese Patent Application (OPI) No. 160141/84; salicyclic acids as described in Japanese Patent Application (OPI) No. 180588/84; alkanolamines as described in Japanese Patent Application (OPI) No. 3532/79; poly(alkyleneimines) as described in Japanese Patent Application (OPI) No. 94349/81; and gluconic acid derivatives as described in Japanese Patent Application (OPI) No. 75647/81, etc. These preservatives may optionally be used in combination.

The pH of the color-developing solution to be used in the present invention is from 9 to 12, preferably from 9 to 11.0. The present color-developing solution may further comprise compounds known as components of developing solution.

In order to maintain the pH value described above, the present color-developing solution preferably contains one or more of various buffers.

Examples of buffers which can be used in the present invention include carbonates, phosphates, borates, tetraborates, hydroxybenzoates, glycidates, N,N-dimethylglycinates, leucinates, norleucinates, guaninates, 3,4-dihydroxyphenylalaninates, alaninates, aminobutyrates, 2-amino-2-methyl-1,3-propanediolates, valinates, prolinates, trishydroxyaminomethane salts, and lysine salts. In particular, carbonates, phosphates, tetraborates, and hydroxybenzoates are preferably used because these buffers are advantageous in that they are excellent in solubility and buffering action in a high pH range of 9.0 or above, that they give no adverse effects (e.g., fogging) to photographic properties when added to a color-developing solution, and that they are available at econimical prices.

Specific examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate), etc. However, the present invention should not be construed as being limited thereto.

The amount of buffer to be added to the color-developing solution is preferably 0.1 mol/liter or more, and particularly preferably from 0.1 mol/liter to 0.4 mol/liter.

In order to prevent precipitatin of calcium or magnesium, and improve stability, the present color-developing solution may contain various chelating agents.

As suitable chelating agents there may be preferably used organic acid compounds. Examples of such organic acid compounds include aminopolycarboxylic acids as described in Japanese Patent Publication Nos. 30496/73 and 30232/69, organic phosphonic acids as described in Japanese Patent Application (OPI) No. 97347/81, Japanese Patent Publication No. 39359/81, and West German Pat. No. 2,227,639, phosphonocarboxylic acids as described in Japanese Patent Application (OPI) Nos. 102726/77, 42730/78, 121127/79, 126241/80 and 65956/80, and compounds as described in Japanese Patent Application (OPI) Nos. 195845/83 and 203440/83, and Japanese Patent Publication No. 40900/78. Specific examples of these compounds will be described hereinafter, but the present invention should not be construed as being limited thereto.

Nitrilotriacetic acid
Diethylenetriaminepentaacetic acid
Triethylenetetraminehexaacetic acid
N,N,N-Trimethylenephosphonic acid
Ethylenediamine-N,N,N',N'-tetramethylenephosphonic acid
1,3-Diamino-2-propanoltetraacetic acid
Transcyclohexanediaminetetraacetic acid
Nitrilotripropionic acid
1,2-Diaminopropanetetraacetic acid
Hydroxyethyliminodiacetic acid
Glycoletherdiaminetetraacetic acid
Hydroxyethylenediaminetriacetic acid
Ethylenediamineorthohydroxyphenylacetic acid
2-Phosphonobutane-1,2,4-tricarboxylic acid
1-Hydroxyethylidene-1,1-diphosphonic acid These chelating agents may optionally be used in combination.

The added amount of such a chelating agent may be such that it is enough to block metal ions in the color-developing solution. For example, it may be in the range of from 0.1 to 10 g/liter.

The present color-developing solution may optionally contain any suitable development accelerators. However, the present color-developing solution does not substantially contain benzyl alcohol. The content of benzyl alcohol in the present color-developing solution is 0.5 ml/l or less. The present color-developing solution is preferably free of benzyl alcohol. Examples of other development accelerators which may be added to the present color-developing solution include thioether compounds as described in Japanese Patent Publication Nos. 16088/62, 5987/62, 7862/63, 12380/69 and 9019/70, and U.S. Pat. No. 3,813,247, p-phenylenediamine compounds as described in Japanese Patent Application (OPI) Nos. 49829/77 and 15554/75, quaternary ammonium salts as described in Japanese Patent Application (OPI) Nos. 137726/75, 156826/81 and 43429/77, and Japanese Patent Publication No. 30074/69, p-aminophenols as described in U.S. Pat. Nos. 2,610,122 and 4,119,462, amine compounds as described in U.S. Pat. Nos. 2,494,903, 3,128,182, 4,230,796, 3,253,919, 2,482,546, 2,596,926 and 3,582,346, and Japanese Patent Publication No. 11431/66, polyalkylene oxides as described in Japanese Patent Publication Nos. 16088/62, 25201/67, 11431/66 and 23883/67, and U.S. Pat. Nos. 3,128,183 and 3,532,501, 1-phenyl-3-pyrazolidones, hydrazines, mesoionic compounds, thionic compounds, imidazoles, etc. These compounds can be optionally added to the present color-developing solution.

Also, if desired, the color-developing solution may contain an antifoggant. Examples of the antifoggant include alkali metal halides such as potassium bromide, sodium bromide, potassium iodide, etc., and organic anti-foggants such as nitrogen-containing heterocyclic compounds (e.g., benzotriazole, 6-nitrobenzimidazole, 5-nitroindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, adenin, etc.), mercapto-substituted heterocyclic compounds (e.g., 1-phenyl-5-mercaptotetrazole, 2-mercaptobenzimidazole, 2-mercaptobenzothiazole, etc.), and mercapto substituted aromatic compounds (e.g., thiosalicyclic acid, etc.). The nitrogen-containing heterocyclic compounds are particularly preferred. The antifoggant may be accumulated in a color-developing solution by dissolving out from color photographic materials during processing.

The present color-developing solution preferably contains a brightening agent. As such a brightening agent, a 4,4'-diamino-2,2'-disulfostilbene compound is preferably used. The added amount of the brightening agent is generally up to 5 g/liter, and preferably from 0.1 to 2 g/liter.

Furthermore, the present color-developing agent may optionally contain various surface active agents such as alkylphosphonic acid, arylphosphonic acid, aliphatic carboxylic acid, and aromatic carboxylic acid.

The processing temperature of the present color-developing solution is generally from 20° to 50° C. and preferably from 30° to 40° C. The processing time is generally from 20 seconds to 5 minutes, and preferably from 30 seconds to 2 minutes. The amount of the color-developing solution to be replenished is preferably small and is generally from 20 to 600 ml, preferably from 50 to 300 ml, and more preferably from 100 to 200 ml, per $m^2$ of light-sensitive material.

In the present invention, the color development is followed by bleach-fixing.

The processing time of the bleach-fixing in the present invention is 1 minute or less, and thus is much shorter than that of the ordinary bleach-fixing (about 1.5 minutes). The terminology "processing time of the bleach-fixing (hereinafter referred to as "bleach-fixing time")" as used herein means the time from the time when the light-sensitive material is first brought into contact with the bleach-fixing solution until the time when it is brought into contact with rinsing water in the subsequent bath plus the time required by the light-sensitive material to be transferred between the baths, i.e., the period for which the light-sensitive material is in the air. In the present invention, the bleach-fixing time is preferably from 30 to 60 seconds.

The present bleach-fixing solution contains as a preservative a sulfite ion-releasing compound such as sulfite (e.g., sodium sulfite, potassium sulfite, ammonium sulfite, etc.), bisulfite (e.g., ammonium bisulfite, sodium bisulfite, potassium bisulfite, etc.), and metabisulfite (e.g., potassium metabisulfite, sodium metabisulfite, ammonium metabisulfite, etc.). The content of such a compound is preferably from about 0.02 to 0.30 mol/liter, more preferably from 0.10 to 0.20 mol/liter, as calculated in terms of amount of sulfite ions.

Examples of other preservatives which can be used in the present invention include hydroxylamine, hydrazine, and bisulfurous acid addition products of aldehyde compounds (e.g., acetoaldehyde sodium bisulfite).

Examples of bleaching agents which may be used in the present bleach-fixing bath include organic acid salts of iron (III) (e.g., iron complex salts with aminopolycarboxylic acids such as ethylenediaminetetraacetic acid and diethylenetriaminepentaacetic acid, aminopolyphosphonic acid, phosphonocarboxylic acid, or organic phosphonic acid), organic acids such as citric acid, tartaric acid, and malic acid, persulfates, and hydrogen peroxide. Among these compounds, organic complex salts of iron (III) are preferably used with rapid treatment because they do not give pollution. Examples of aminopolycarboxylic acids, aminopolyphosphonic acids, organic phosphonic acids, and salts thereof useful in the formation of such organic complex salts of iron (III) include ethylenediaminetetraacetic acid, diethylenetriaminepentaacetic acid, ethylenediamine-N-(β-oxyethyl)-N,N',N'-triacetic acid, 1,3-diaminopropanetetraacetic acid, triethylenetetraminehexaacetic acid, propylenediaminetetraacetic acid, nitrilotriacetic acid, nitrilotripropionic acid, cyclohexanediaminetetraacetic acid, 1,3-diamino-2-propanoltetraacetic acid, methyliminodiacetic acid, iminodiacetic acid, hydroxyliminodiacetic acid, dihydroxyethylglycineethyletherdiaminetetraacetic acid, glycoletherdiaminetetraacetic acid, ethylenediaminetetrapropionic acid, ethylenediaminedipropionacetic acid, phenylenediaminetetraacetic acid, 2-phosphonobutane-1,2,4-triacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and 1-hydroxyethylidene-1,1'-diphosphonic acid.

These complex salts may be any of sodium salts, potassium salts, lithium salts, and ammonium salts. Among these compounds, complex salts of iron (III) with ethylenediaminetetraacetic acid, diethylenetriaminepentaacetic acid, cyclohexanediaminetetraacetic acid, 1,3-diaminopropanetetraacetic acid, and methyliminodiacetic acid are preferably used because they have a high bleaching capability.

The amount of such a bleaching agent is preferably from 0.05 to 0.5 mol, and more preferably from 0.1 to 0.4 mol, per liter of bleach-fixing solution for the purpose of speeding up the processing.

As suitable fixing agents for the present bleach-fixing solution, known fixing agents may be used. Examples of such known fixing agents include thiosulfates such as sodium thiosulfate, and ammonium thiosulfate, thiocyanates such as sodium thiocyanate, and ammonium thiocyanate, and water-soluble silver halide solvents such as ethylenebisthioglycolic acid, thioether compound (e.g., 3,6-dithia-1,8-octanediol), and thiourea. These compounds may be used singly or in combination. Furthermore, a specific bleach-fixing solution comprising a combination of a fixing agent and a large amount of a halide such as potassium iodide as described in Japanese Patent Application (OPI) No. 155354/80 may optionally be used. In the present invention, thiosulfates, particularly ammonium salts of thiosulfuric acid are preferably used.

The amount of such a fixing agent to be used is preferably from 0.3 to 2 mol, and more preferably from 0.5 to 1.5 mol, per liter of bleach-fixing solution.

The pH of the present bleach-fixing solution is preferably in the range of from 4 to 8, and more preferably from 5 to 7.5. If the pH of the bleach-fixing solution is less than the above range, its capability of desilvering is improved, but the deterioration of the solution is accelerated and the cyan dye becomes a leuco dye more easily. On the contrary, if the pH is higher than the above range, its desilvering capability becomes poor and the photographic light-sensitive material is more subject to stain.

In order to adjust the pH of the bleach-fixing solution, the present bleach-fixing solution may optionally comprise hydrochloric acid, sulfuric acid, nitric acid, acetic acid, bicarbonate, ammonia, caustic potassium, caustic soda, sodium carbonate, potassium carbonate, or the like.

The present bleach-fixing solution may optionally contain various brightening agents, anti-foaming agents, surface active agents, or organic solvents such as polyvinyl pyrrolidone and methanol.

Furthermore, the present bleach-fixing solution may optionally contain a bleaching accelerator. Specific examples of useful bleaching accelerators include compounds containing mercapto groups or disulfide groups as described in U.S. Pat. No. 3,893,858, West German Pat. Nos. 1,290,812 and 2,059,988, Japanese Patent Application (OPI) Nos. 32736/78, 57831/78, 37418/62, 65732/78, 72623/78, 95630/78, 95631/78, 104232/78, 124424/78, 141623/78, and 28426/78, and *Research Disclosure,* RD No. 17129 (July, 1978), thiazolidine derivatives as described in Japanese Patent Application (OPI) No. 140129/75, thiourea derivatives as described in Japanese Patent Publication No. 8506/70, Japanese Patent Application (OPI) Nos. 20832/77 and 32735/78, and U.S. Pat. No. 3,706,561, iodides as described in West German Pat. No. 1,127,715 and Japanese Patent Application (OPI) No. 16235/83, polyethylene oxides as described in West German Pat. Nos. 966,410 and 2,748,430, polyamine compounds as described in Japanese Patent Publication No. 8836/70, compounds as described in Japanese Patent Application (OPI) Nos. 42434/74, 59644/74, 94927/78, 35727/79, 26506/80 and 163940/83, iodine ion, and bromine ion. Among these compounds, compounds containing mercapto groups or disulfide groups are preferably used because they have a high bleaching acceleration effect. In particular, compounds as described in U.S. Pat. No. 3,893,858, West German Pat. No. 1,290,812, and Japanese Patent Application (OPI) No. 95630/78 are preferably used.

Moreover, the present bleach-fixing solution may contain a halogenating agent such as bromide (e.g., potassium bromide, sodium bromide, ammonium bromide, etc.), chloride (e.g., potassium chloride, sodium chloride, ammonium chloride, etc.), and iodide (e.g., ammonium iodide). The present bleach-fixing solution may also contain one or more inorganic or organic acid having a pH buffering capacity such as boric acid, borax, sodium metaborate, acetic acid, sodium acetate, sodium carbonate, potassium carbonate, phosphorus acid, phosphoric acid, sodium phosphate, citric acid, sodium citrate, and tartaric acid, or salts thereof with alkali metals or ammonium salts thereof, or an anticorrosive agent such as ammonium nitrate, and guanidine.

The processing temperature of the present bleach-fixing process is generally from 10° to 50° C., and preferably from 20° to 40° C. The amount of the present bleach-fixing solution to be replenished is generally from 20 to 600 ml, and preferably from 30 to 200 ml, per $m^2$ of light-sensitive material.

The desilvering process (bleach-fixing or fixing process) is followed by washing and/or stabilizing process. In the washing and stabilizing processes, various compounds can be used for various purposes. For example, it is known that germicides or fungicides are used to prevent development of various bacteria, algae, or fungi. Specific examples of compounds and usages which can be applied to the present invention are described in *J. Antibact. Antifung. Agents,* Vol. 11, No. 5, pp. 207–223 (1983); *Bokin Bobai no Kagaku* (*Chemistry of Antibacterials and Antifungals*), (edited by Hiroshi Horiguchi); Japanese Patent Application (OPI) Nos. 8543/82, 58143/82, 97530/82, 105145/83, 135636/83, 91440/84, 126533/84, 184344/84, 185336/84, 239750/85, 239751/85, 247241/85, 260952/85, 2149/86, 28947/86, 28945/86 and 35446/86, and European Patent No. 204,197. In particular, isothiazolone derivatives such as 2-octyl-4-isothiazoline-3-one, and 5-chloro-2-methyl-4-isothiazoline-3-one, sulfanylamide derivatives such as sulfanylamide, and benzotriazole derivatives such as benzotriazole, 5-methylbenzotriazole, and 5-chlorobenzothiazole are useful. It is known that various chelating agents are used in order to improve image stability after processing. For example, inorganic phosphoric acids, organic carboxylic acids, aminopolycarboxylic acids, and organic phosphonic acids are useful. Specific examples of useful compounds and usages which can be applied to the present invention are described in Japanese Patent Application (OPI) Nos. 8543/82, 197540/82, 14834/83, 134636/83, 126533/84, 184343/84, 184344/84, 184345/84, 185336/84, 135942/85, 238832/85, 239748/85, 239749/85, 239750/85, 239751/85, 242458/85, 262161/85, 4047/86, 4050/86, 4051/86, 4052/86, 4053/86, 4054/86, 28942/86, and 28945/86. In particular, ethylenediaminetetraacetic acid, diethylenetraminepentaacetic acid, nitrilotriacetic acid, 1-hydroxyethylidene-1,1'-diphosphonic acid, nitrilo-N,N,N-trimethylenephosphonic acid, and ethylenediamine-N,N,N',N'-tetramethylphosphonic acid are useful.

These chelating agents can be used in combination with metal compounds. For example, bismuth compounds as described in Japanese Patent Application (OPI) No. 134636/83, Ba, Ca, Ce, Co, In, La, Mn, Ni, Pb, Ti, Sn, Zn and Zr compounds as described in Japanese Patent Application (OPI) No. 184344/84, and Mg, Al and Sr compounds as described in Japanese Patent Application (OPI) No. 185336/84 can be used. In particular, Bi, Ca, Mg and Al compounds are useful.

Furthermore, suitable surface active agents can be used in order to facilitate washing process as described in Japanese Patent Application (OPI) No. 197540/82. Moreover, in order to remove components that give adverse effects, various processes can be used. Examples of such processes include a process in which the light-sensitive material is brought into contact with an ion exchange resin as described in Japanese Patent Application (OPI) No. 220345/85, a process in which the light-sensitive material is subjected to reverse osmosis treatment as described in Japanese Patent Application (OPI) No. 241053/85, a process in which the light-sensitive material is brought into contact with activated carbon, clay substance, polyamide high molecular weight compound, polyurethane high molecular weight compound, phenol resin, epoxy resin, a high molecular weight compound containing hydrazide groups, a high molecular weight compound containing polytetrafluoroethylene, or monoester of monovalent or polyvalent alcohol with methacrylic acid-polyester or polyvalent alcohol with methacrylic acid copolymer as described in Japanese Patent Application (OPO) No. 263151/85, and a process in which the light-sensitive material is subjected to electrodialysis as described in Japanese Patent Application (OPI) No. 28949/86.

Furthermore, a process in which the light-sensitive material is irradiated with ultraviolet rays or passed through a magnetic field may be used as a process for preventing generation of bacteria or fungi. If it is desired to keep the light-sensitive material treated for prevention of generation of bacteria or fungi, processes as described in Japanese Patent Application (OPI) Nos. 233651/85, 235133/85, 263941/85, 4048/86, 4049/86, 4055/86, 4056/86, 4057/86, 4058/86 and 4060/86 can be applied.

The present washing bath and stabilizinb bath may contain brightening agents, hardeners, or the like besides the above-mentioned additives.

As agents for adjusting the pH of a film after being processed there may be preferably used various ammonium salts such as ammonium chloride, ammonium nitrate, ammonium sulfate, ammonium phosphate, ammonium sulfite, and ammonium thiosulfate for the purpose of improving image stability.

These same or different kinds of additives may optionally be used in combination depending on its purposes. The amount of these additives to be used is preferably a minimum amount enough to attain the object in the light of the properties of the emulsion film of the light-sensitive material which has been processed (e.g., stickiness).

The present washing process or stabilizing process (i.e., a rinsing process) is preferably conducted in a multistage countercurrent manner using two or more baths in order to minimize an amount of the rinsing solution (i.e., a washing solution and/or stabilizing solution) to be replenished. The replenished amount of the rinsing solution (i.e., the washing solution and/or the stabilizing solution) is preferably from 0.1 to 50 times, and more preferably from 3 to 30 times, the amount of the solution which is carried by the silver halide color photographic material from the preceding bath (i.e., the bleach-fixing bath or the preceding rinsing bath), per unit area of the photographic material.

The present washing or stabilizing time depends on the type of light-sensitive material or processing conditions and is generally from 20 seconds to 2 minutes, preferably from 20 seconds to 1.5 minutes.

The present washing or stabilizing temperature is generally from 20° to 45° C., preferably from 25° to 40° C., and more preferably from 30° to 35° C.

In order to facilitate removal of unnecessary components from the film in the washing or stabilizing process, the processing solution is preferably circulated and stirred. In particular, the stirring process is preferably such that a flow of solution strongly hits the surface of the emulsion film of the light-sensitive material (e.g., gas stirring, solution spray, etc.).

If desired, each processing tank may be equipped with a heater, a temperature sensor, a liquid level sensor, a circulating pump, a filter, a floating lid, a squeegee, a nitrogen gas stirrer, an air stirrer, etc.

The silver halide emulsion for use in the present invention contains silver bromide, silver chlorobromide, or silver chloride each containing substantially no silver iodide and contains silver chlorobromide containing preferably from 2 to 98 mol%, and particularly preferably from 30 to 98 mol%, of silver chloride.

The term "containing substantially no silver iodide" means that the silver halide emulsion contains silver iodide in a concentration of generally 2 mol% or less, preferably 1 mol% or less, and particularly preferably 0 mol%.

The silver halide grains for use in the present invention may differ in composition or phase between the inside and the surface layer thereof, may have a multiphase structure having a junction structure, or may have a uniform phase or composition throughout the whole grain. Also, the silver halide grains may be composed of a mixture of these grains having different phase structures.

The mean grain size (the diameter of the grain when the grain is spherical or resembles spherical, or the mean value based on the project area using the edge length as the grain size when the grain is a cubic grain) of the silver halide grains for use in the present invention is preferably from 0.1 μm to 2 μm, and more preferably from 0.15 μm to 1 μm.

The grain size distribution of a silver halide emulsion for use in the present invention may be narrow or broad, but a so-called monodispersed silver halide emulsion wherein the value (fluctuation) obtained by dividing the standard deviation in the grain distribution curve by the mean grain size is within about 20%, and preferably within 15%, is preferably used in the present invention. Also, for satisfying the gradation required for a color photographic material, two or more kinds of monodispersed silver halide emulsions (preferably having the above-described fluctuation as the monodispersibility) can exist in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The silver halide grains for use in the present invention may have a regular crystal form such as cubic, octahedral, dodecahedral, tetradecahedral, etc., or an irregular crystal form such as spherical, or further a composite form of these crystal forms. Also, a tabular grain silver halide emulsion can be used in the present invention. In particular, a tabular grain silver halide emulsion wherein tabular silver halide grains having an aspect ratio (length/width) of at least 5, in particular, at least 8, account for at least 50% of the total project area of the silver halide grains may be used. The silver halide emulsion for use in the present invention may be a mixture of these emulsions containing silver halide grains each having different crystal form. Also, the silver halide grains may be of a surface latent image type capable of forming latent images mainly on the surfaces thereof or of an internal latent image type capable of forming latent images mainly in the inside thereof.

The silver halide photographic emulsions for use in the present invention can be prepared using the methods described, for example, in P. Glafkides, *Chimie et Physique Photographique* (published by Paul Montel, 1967); G. F. Duffin, *Photographic Emulsion Chemistry* (published by Focal Press, 1966); V. L. Zelikman et al., *Making and Coating Photographic Emulsion* (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the existence of excessive silver ions can be employed. As one system of the double jet method, a so-called controlled double jet method of keeping a constant pAg in a liquid phase of forming silver halide grains can also be employed. According to the method, a silver halide emulsion containing silver halide grains having a regular crystal form and almost uniform grain sizes can be obtained.

Furthermore, a silver halide emulsion prepared by a so-called conversion method including a step of converting a silver halide already formed into a silver halide having a less solubility product before the formation step of the silver halide grains is finished or a silver halide emulsion prepared by applying the similar halogen conversion to silver halide grains after finishing the formation step of the silver halide grains can also be used.

The silver halide grains may also be formed, or physically ripened, in the presence of a cadmium salt, a zinc salt, a lead salt, a thallium salt, an iridium salt or a complex salt thereof, a rhodium salt or a complex salt thereof, an iron salt or a complex salt thereof, etc.

After the formation of silver halide grains, the silver halide emulsion thus obtained is usually subjected to physical ripening, subjected to desalting, and then subjected to chemical ripening before coating.

In this case, a silver halide solvent (e.g., ammonia, potassium rhodanate, and the thioethers and thione compounds described in U.S. Pat. No. 3,271,157, Japanese Patent Application (OPI) Nos. 12360/76, 82408/78, 144319/78, 100717/79, 155828/79, etc.) can be used for the precipitation, physical ripening, and chemical ripening of silver halide emulsions. For removing soluble salts from silver halide emulsion after physical ripening, a noodle washing method, a flocculation settling method, an ultrafiltration method, etc., can be used.

For the chemical sensitization of the silver halide emulsions for use in the present invention, a sulfur sensitization method using active gelatin or a sulfur-containing compound capable of reacting silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a metal compound (e.g., gold complex salts and complex salts of metals belonging to group VIII of the Periodic Table, such as platinum, iridium, palladium, rhodium, iron, etc.) can be used individually or as a combination thereof.

Of the chemical sensitization methods described above, the sulfur sensitization method is preferably used.

The color photographic material which is processed by the process of the present invention has preferably at least one blue-sensitive emulsion layer, at least one green-sensitive emulsion layer and at least one red-sensitive emulsion layer, the silver halide emulsions of which are spectrally sensitized by methine dyes, etc., to have each color sensitivity. The dyes used for the purpose include cyanine dyes, merocyanine dyes, complex cyanine dyes, complex merocyanine dyes, holopolar cyanine dyes, hemicyanine dyes, styryl dyes, and hemioxonol dyes. The particularly useful dyes are cyanine dyes, merocyanine dyes and complex merocyanine dyes.

For these dyes can be applied various nuclei which are usually utilized for cyanine dyes as basic heterocyclic nuclei. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei and the nuclei obtained by fusing aromatic hydrocarbon rings to these nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. Each of these nuclei may be substituted on the carbon atom of the dye.

For the merocyanine dyes or complex merocyanine dyes can be applie 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure.

The above-described sensitizing dyes can be used singly or as a combination thereof. A combination of sensitizing dyes is frequently used for the purpose of super color sensitization. Specific examples of the super color sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, Japanese Patent Application (OPI) Nos. 110618/77, 109925/77, etc.

The silver halide emulsions for use in the present invention may further contain, together with the sensitizing dye(s), dyes having no spectral sensitizing action by themselves or materials which do not substantially absorb visible light but show supersensitizing action.

It is preferred that the couplers contained in the color photographic materials which are processed by the process of the present invention are nondiffusible due to having a ballast group or being polymerized.

Also, the use of 2-equivalent color couplers substituted by a releasable group can reduce the amount of silver for the color photographic materials as compared to 4-equivalent color couplers having a hydrogen atom at the coupling active group. Couplers giving colored dyes having a proper diffusibility, non-color-forming couplers, DIR couplers releasing a development inhibitor with coupling reaction, or DAR couplers releasing a development accelerator with coupling reaction can also be used in the present invention.

In the present invention, yellow couplers, magenta couplers (including the magenta couplers of formula (II) described hereinbefore), and cyan couplers can be used for the color photographic materials when the present invention is applied for multicolor photographic materials.

As the yellow couplers for use in the present invention, there are oil protect type acylacetamido couplers as the typical examples. Specific examples of these couplers are described in U.S. Pat. Nos. 2,407,210, 2,875,057, 3,265,506, etc. In the present invention, 2-equivalent yellow couplers are preferably used and specific examples of these yellow couplers are the oxygen atom-releasing type yellow couplers described in U.S. Pat. Nos. 3,408,194, 3,447,928, 3,933,501, 4,022,620, etc., and the nitrogen atom-releasing type yellow couplers described in Japanese Patent Publication No. 10739/83, U.S. Pat. Nos. 4,401,752, 4,326,024, *Research Disclosure,* RD No. 18053(April, 1979), British Pat. No. 1,425,020, West German Patent Application (OLS) Nos. 2,219,917, 2,261,361, 2,329,587, 2,433,812, etc. In these yellow couplers, α-pivaloylacetanilide couplers are excellent in fastness, in particular light fastness of colored dyes formed, while α-benzoylacetanilide couplers are excellent in coloring density.

As suitable magenta couplers for the present invention, oil-protect type indazolone series or cyanoacetyl series, preferably 5-pyrazolone series and pyrazoloazole series such as pyrazolotriazoles can be used. As the 5-pyrazolone series magenta couplers which can be used together with or as a combination with the pyrazoloazole couplers, couplers substituted by an arylamino group or an acylamino group at the 3-position thereof are preferred from the viewpoint of the hue and coloring density of the colored dyes formed. Specific examples of these couplers are described in U.S. Pat. Nos. 2,311,082, 2,343,703, 2,600,788, 2,908,573, 3,062,653, 3,152,896, 3,936,015, etc. Also, as the releasable group for the 2-equivalent 5-pyrazolone series couplers, the nitrogen atom-releasing groups described in U.S. Pat. No. 4,310,619 and the arylthio groups described in U.S. Pat. No. 4,351,897 are preferred. Furthermore, the 5-pyrazolone series magenta couplers having a ballast group described in European Pat. No. 73,636 give high coloring density.

As suitable pyrazoloazole couplers there may be used pyrazolobenzimidazoles as described in U.S. Pat. No. 3,369,879, preferably pyrazolo[5,1-c][1,2,4]-triazoles as described in U.S. Pat. No. 3,725,067, pyrazolotetrazoles as described in *Research Disclosure,* RD No. 24220 (June, 1984), and pyrazolopyrazoles as described in ibid., RD No. 24230 (June, 1984). Imidazo-[1,2-b]pyrazoles as described in European Pat. No. 119,741 are preferably used because their color-forming dyes show a small yellow auxiliary absorption and are excellent in fastness to light. In particular, pyrazolo-[1,5-b][1,2,49 triazole as described in European Pat. No. 119,860 is preferably used.

As the cyan couplers for use in the present invention, there are oil-protect type naphthol series or phenol series couplers. Specific examples of the naphthol series couplers include the cyan couplers described in U.S. Pat. No. 2,474,293 and preferably the oxygen atom-releasing tyep 2-equivalent naphthol series couplers described in U.S. Pat. Nos. 4,052,212, 4,146,396, 4,228,233 and 4,296,200. Also, specific examples of the phenol series cyan couplers are described in U.S. Pat. Nos. 2,369,929, 2,801,171, 2,772,162, 2,894,826, etc. Cyan couplers having high fastness to humidity and temperature are preferably used in the present invention and typical examples of these cyan couplers include the phenol series cyan couplers having an alkyl group of 2 or more carbon atoms at the meta-position of the phenol nucleus described in U.S. Pat. No. 3,772,002, the 2,5-diacylamino-substituted phenol series cyan couplers described in U.S. Pat. Nos. 2,772,162, 3,758,308, 4,126,396, 4,334,011, 4,327,173, West German Patent Application (OLS) No. 3,329,729, Japanese Patent Application (OPI) No. 42671/83, etc., and the phenol series couplers having a phenylureido group at the 2-position thereof and an acylamino group at the 5-position thereof described in U.S. Pat. Nos. 3,446,622, 4,333,999, 4,451,559 and 4,427,767.

In the present invention, by using couplers giving colored dyes having a proper diffusibility together with the aforesaid color couplers, the graininess of color images formed can be improved. Specific examples of the magenta couplers giving such diffusible dyes are described in U.S. Pat. Nos. 4,366,237 and British Pat. No. 2,125,570 and specific examples of yellow, magenta and cyan couplers of this type are described in European Pat. No. 96,570 and West German Patent Application (OLS) No. 3,234,533.

The dye-forming couplers or the above-described specific couplers for use in the present invention may form dimers or higher polymers. Typical examples of the polymerized dye-forming couplers are described in U.S. Pat. Nos. 3,451,820 and 4,080,211. Also, specific examples of the polymerized magenta couplers are described in British Pat. No. 2,102,173 and U.S. Pat. No. 4,367,282.

The various kinds of couplers for use in the present invention may be used for the same photographic layer of a color photographic material as a combination of two or more kinds thereof for meeting particular characteristics desired for a color photographic material, or the same kind of coupler may be used for two or more photographic layers for meeting desired characteristics.

The incorporation of the present couplers into the light-sensitive material can be accomplished by an oil-in-water dispersion method. In such an oil-in-water dispersion method, the present couplers are dissolved in one or a mixture of a high boiling point organic solvent having a boiling point of 175° C. or above and a low boiling point solvent, i.e., so-called auxiliary solvent, and the solvent thus obtained is finely dispersed in water or an aqueous medium such as aqueous gelatin solution in the presence of a surface active agent. Examples of such a high boiling point organic solvent are described in U.S. Pat. No. 2,322,027. The dispersion may be accompanied by phase inversion. The auxiliary solvent may optionally be removed or decreased by distillation, noodle rinsing, or ultrafiltration before the coupler dispersion is coated on the light-sensitive layer.

Specific examples of such high boiling point organic solvents include phthalic esters such as dibutyl phthalate, dicyclohexyl phthalate, di-2-ethylhexyl phthalate, and decyl phthalate, phosphoric and phosphonic esters such as triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate, benzoic esters such as 2-ethylhexyl benzoate, dodecyl benzoate, and 2-ethylhexyl-p-hydroxy benzoate, amides such as diethyldodecanamide and N-tetradecyl pyrrolidone, alcohols and phenols such as isostearyl alcohol and 2,4-di-tert-amylphenol, aliphatic carboxylic esters such as dioctylazelate, glycerol tributyrate, isostearyl lactate, and trioctyl citrate, aniline derivatives such as N,N-dibutyl-2-butyoxy-5-tert-octylaniline, and hydrocarbons such as paraffins, dodecylbenzene, and diisopropyl naphthalene. Suitable auxiliary solvents that may be used include organic solvents having a boiling point of about 30° C. or more, preferably 50° C. to about 160° C. Typical examples of such organic solvents include ethyl acetate, butyl acetate, ethyl propionate, methyl ethyl ketone, cyclohexanone, 2-ethoxyethyl acetate and dimethylformamide.

Specific examples of process and effect of latex dispersion and latex for use in impregnation are described in U.S. Pat. No. 4,199,363, and West German Patent Application (OLS) Nos. 2,541,274 and 2,541,230.

The amount of the color couplers to be used is generally in the range of from 0.001 to 1 mol, and preferably from 0.01 to 0.5 mol, for yellow coupler, from 0.003 to 0.3 mol for magenta coupler, and from 0.002 to 0.3 mol for cyan coupler, per mol of light-sensitive silver halide.

The light-sensitive material prepared in accordance with the present invention may contain as a color fog preventing agent or color mixing preventing agent a hydroquinone derivative, an aminophenol derivative, an amine, a gallic acid deriative, a catechol derivative, an ascorbic acid derivative, a colorless coupler, a sulfonamidophenol derivative, or the like.

Also, the color photographic light-sensitive materials for use in the present invention may further contain organic anti-fading agents. Examples of such organic anti-fading agents include hindered phenols such as hydroquinones, 6-hydroxycoumarones, 5-hydroxycoumarans, spirochromans, p-alkoxyphenols, or bisphenols, gallic acid derivatives, methylenedioxybenzenes, aminophenols, hindered amines, and also the ether or ester derivatives obtained by silylating or alkylating the phenolic hydroxy groups of these compounds. Also, metal complexes such as (bissalicylaldoximate) nickel complex and (bis-N,N-dialkyldithiocarbamate) nickel complex can be used as anti-fading agent.

The use of the compound having both the moiety structure of hindered amine and hindered phenol in the same molecule as described in U.S. Pat. No. 4,268,593 for the color photographic materials give good results for preventing the deterioration of the yellow dye images by heat, humidity, and light. Also, for repreventing the deterioration of magenta dye images, particularly by light, the use of the spiroindanes described in Japanese Patent Application (OPI) No. 159644/81 or the chromans having a hydroquinone diether or monoether as a substituent described in Japanese Patent Application (OPI) No. 89835/80 gives preferred results.

For improving the stability of cyan images, in particular the light fastness thereof, it is preferred to use benzotriazole series ultraviolet absorbents for the color photographic materials. The ultraviolet absorbent may be co-emulsified with a cyan coupler.

The ultraviolet absorbent may be used in a coating amount sufficient for imparting light stability to the cyan dyee images formed, but if too great of an amount of the agent is used, yellowing sometimes occurs at the unexposed portions (background portions) of color photographic light-sensitive material after processing, and hence the amount is in the range of usually from $1\times10^{-4}$ mol/m$^2$ to $2\times10^{-3}$ mol/m$^2$, preferably from $5\times10^{-4}$ to $1.5\times10^{-3}$ mol/m$^2$.

In an ordinary layer constitution of color photographic paper, an ultraviolet absorbent exists in one or preferably both layers disposed at both sides of a cyan coupler-containing red-sensitive silver halide emulsion layer. Also, when an ultraviolet absorbent is incorporated in an interlayer between a green-sensitive emulsion layer and a red-sensitive emulsion layer, the agent may be co-emulsified with a color mixing preventing agent. When an ultraviolet absorbent exists in a protective layer, another protective layer may be formed as the outermost layer and the protective layer may contain a matting agent, optionally having particle sizes. Moreover, the color photographic materials for use in the present invention may contain ultraviolet absorbents in hydrophilic colloid layers thereof.

Color photographic materials for use in the present invention may further contain water-soluble dyes in the hydrophilic colloid layers thereof as filter dyes or for the purposes of irradiation prevention, halation prevention, etc.

The color photographic materials for use in the present invention may further contain brightening agents such as stilbene series compounds, triazine series compounds, oxazole series compounds, coumarine series compounds, etc., in the photographic emulsion layers or other hydrophilic colloid layers. In this case, as the brightening agents, water-soluble brightening agents may be used or water-insoluble brightening agents may be used as a form of the dispersion thereof.

The processing process of the present invention can be applied to multilayer multicolor photographic materials having at least two photographic emulsion layers having different spectral sensitization on a support. A multilayer natural color photographic material usually has at least one red-sensitive emulsion layer, at least one green-sensitive emulsion layer, and at least one blue-sensitive emulsion layer on a support. The disposition order of these emulsion layers can be selected according to the intended use. Also, each emulsion layer described above may be composed of two or more emulsion layers, each having different sensitivities. Also, a light-insensitive layer may exist between two or more emulsion layers each having the same color sensitivity.

It is preferred that the color photographic material for use in the present invention has proper auxiliary layers (also referred to as "photograph-constituting layers) such as a protective layer or protective layers, interlayers, a filter layer, an anti-halation layer, a backing layer, etc., in addition to silver halide emulsion layers.

As the binder of protective colloid which can be used for the silver halide emulsion layers, interlayers, etc., of the color photographic materials in the present invention, gelatin is advantageously used, but other hydrophilic colloids can also be used.

For example, there are proteins such as gelatin derivatives, graft polymers of gelatin and other polymers, albumin, casein, etc,; cellulose derivatives such as hydroxyethyl cellulose, carboxymethyl cellulose, cellulose sulfates, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-processed gelatin as well as acid-processed gelatin or the enzyme-processed gelatin as described in *Journal of the Society of Photographic Science and Technology of Japan,* No. 16, p. 30 (1966) can be used. Also, the hydrolyzed products or enzyme decomposed products of gelatin can be used.

The color photographic materials for use in the present invention may further contain various stabilizers, stain preventing agents, developing agents or precursors thereof, development accelerators or precursors thereof, lubricants, mordants, matting agents, antistatic agents, plasticizers and other additives useful for the color photographic materials in addition to the above-described additives. Examples of these additives are described in *Research Disclosure,* RD No. 17643 (December, 1978) and ibid,, RD No. 18716 (November, 1979).

The process of the present invention can preferably be applied to a color photographic material having a reflective support. The reflective support has a high reflectivity for clearly viewing dye images formed in silver halide emulsion layers of the color photographic material. Such a reflective support comprises a support coated with a hydrophobic resin having dispersed therein a light reflective material such as titanium oxide, zinc oxide, calcium carbonate, calcium sulfate, etc., and a support composed of a hydrophobic resin having dispersed therein a light reflective material as described above. Examples of the reflective support include baryta-coated papers, polyethylene-coated papers, polypropylene series synthetic papers, and transparent supports (e.g., glass plates, polyester films such as polyethylene terephthalate films, cellulose triacetate films, or cellulose nitrate films, polyamide films, polycarbonate films, polystyrene films, etc.) having a reflective layer or containing a reflective material. These supports can appropriately be selected according to the intended purposes.

The present invention is further illustrated in the following examples, but the present invention should not be construed as being limited thereto.

EXAMPLE 1

Multilayer color photographic papers comprising layer constitution shown in Table A were prepared. As the support there was used a paper comprising polyethylene laminated on both sides thereof. The coating solutions were prepared as follows:

Preparation of Coating Solution for First Layer 27.2 ml of ethyl acetate and 7.9 ml of Solvent (c) were dissolved in 19.1 g of Yellow Coupler (a) and 4.4 g of Dye Image Stabilizer (b). The solution thus prepared was then emulsion-dispersed in 185 ml of a 10 wt% aqueous solution containing 8 ml of 10 wt% sodium dodecylbenzenesulfonate. On the other hand, a blue-sensitive sensitizing dye shown below was added to a silver chlorobromide emulsion (containing 80 mol% of silver bromide and 70 g/kg of Ag) in an amount of $7.0\times10^{-4}$ mol per mol of silver chlorobromide to prepare 90 g of a blue-sensitive emulsion. The emulsion dispersion and the blue-sensitive emulsion thus prepared were mixed with each other in such a manner that the gelatin content providing the compositions shown in Table 1 was attained. Thus, the coating solution for the first layer was prepared. Coating solutions for the second layer to the seventh layer were prepared in the same manner as used for the coating solution for the first layer. As gelatin hardening agent there was used sodium salt of 2,4-dichloro-6-hydroxy-s-triazine.

As spectral sensitizers for each emulsion the following compounds were used:

Blue-Sensitive Emulsion Layer

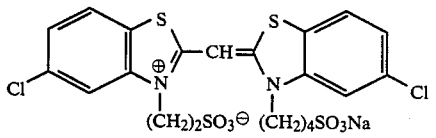

(added amount: $7.0\times10^{-4}$ mol per mol of silver halide)

Green-Sensitive Emulsion Layer

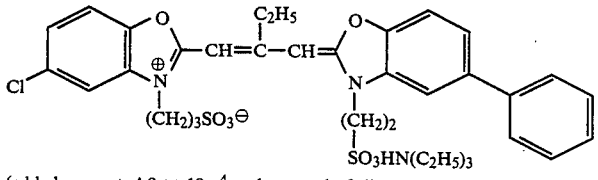

(added amount: $4.0\times10^{-4}$ mol per mol of silver halide)

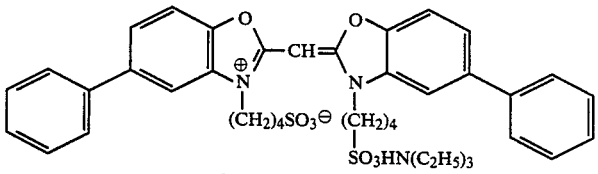

(added amount: $7.0\times10^{-5}$ mol per mol of silver halide)

Red-Sensitive Emulsion Layer

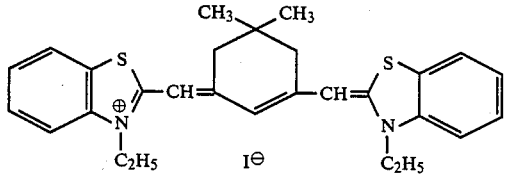

-continued (added amount: $1.0 \times 10^{-4}$ mol per mol of silver halide)

An anti-irradiation dyes for each emulsion layer the following dyes were used:

Green-Sensitive Emulsion Layer

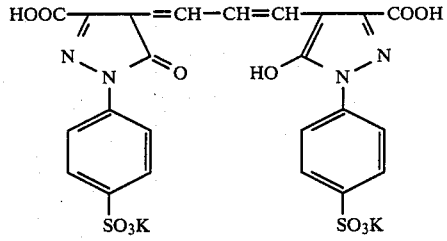

Red-Sensitive Emulsion Layer

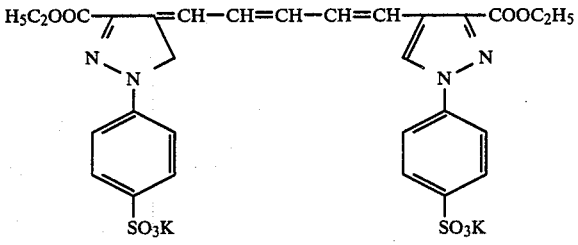

The couplers and other compounds used in the present example have the following structural formulae:

(a) Yellow Coupler

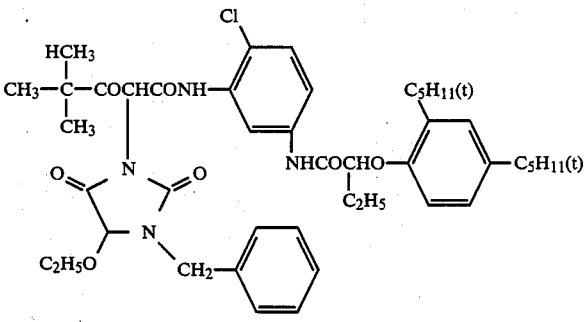

(b) Dye Image Stabilizer

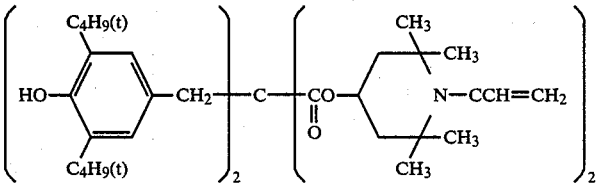

(c) Solvent

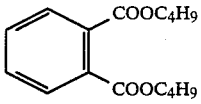

(d) Stain Inhibitor

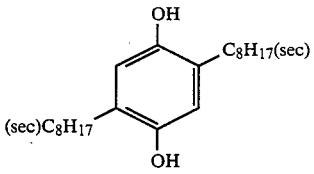

(e) Magenta Coupler

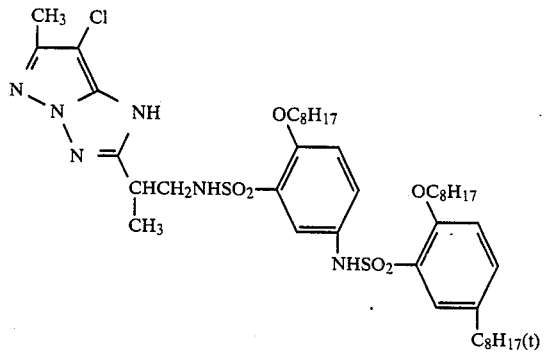

(f) Dye Image Stabilizer

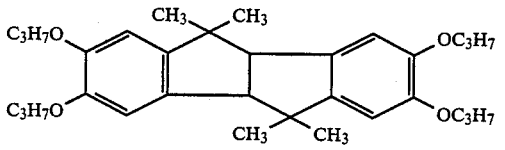

(g) Solvent

2/1 mixture (weight ratio) of

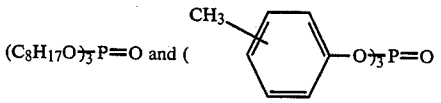

(h) Ultraviolet Absorbing Agent

1/5/3 mixture (molar ratio) of the following three compounds:

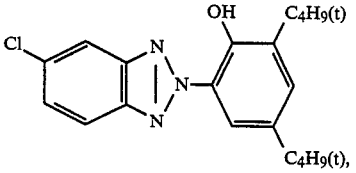

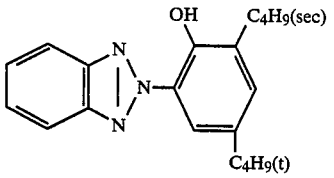

and

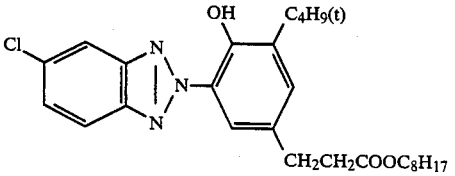

(i) Color Mixing Preventing Agent

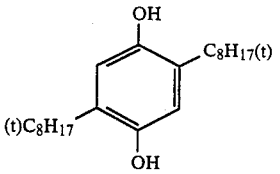

(j) Solvent $(iso\ C_9H_{19}O)_3—P=O$

TABLE A

| | |
|---|---|
| Seventh Layer: Protective Layer | |
| Gelatin | 1.33 g/m$^2$ |
| Acryl modified copolymer of polyvinyl alcohol | 0.17 g/m$^2$ |
| Sixth Layer: Ultraviolet Absorbing Layer | |
| Gelatin | 0.54 g/m$^2$ |
| Ultraviolet Absorbing Agent (h) | 0.09 g/m$^2$ |
| Solvent (j) | 0.09 ml/m$^2$ |
| Fifth Layer: Red-Sensitive Layer | |
| Silver chlorobromide emulsion (silver bromide: 70 mol %) | 0.26 g/m$^2$ (silver) |
| Gelatin | 0.98 g/m$^2$ |
| Cyan Coupler (k) | 0.38 g/m$^2$ |
| Dye Image Stabilizer (l) | 0.17 g/m$^2$ |
| Solvent (m) | 0.23 ml/m$^2$ |
| Fourth Layer: Ultraviolet Absorbing Layer | |
| Gelatin | 1.60 g/m$^2$ |
| Ultraviolet Absorbing Agent (h) | 0.62 g/m$^2$ |
| Stain Inhibitor (i) | 0.05 g/m$^2$ |
| Solvent (j) | 0.26 ml/m$^2$ |
| Third Layer: Green-Sensitive Layer | |
| Silver chlorobromide emulsion (silver bromide: 75 mol %) | 0.16 g/m$^2$ (silver) |
| Gelatin | 1.80 g/m$^2$ |
| Magenta Coupler (e) | 0.34 g/m$^2$ |
| Dye Image Stabilizer (f) | 0.20 g/m$^2$ |
| Solvent (g) | 0.68 ml/m$^2$ |
| Second Layer: Anti-Stain Layer | |
| Gelatin | 0.99 g/m$^2$ |
| Color Mixing Preventing Agent (d) | 0.08 g/m$^2$ |
| First Layer: Blue-Sensitive Layer | |
| Silver chlorobromide emulsion (silver bromide: 80 mol %) | 0.30 g/m$^2$ (silver) |
| Gelatin | 1.86 g/m$^2$ |
| Yellow Coupler (a) | 0.82 g/m$^2$ |
| Dye Image Stabilizer (b) | 0.19 g/m$^2$ |
| Solvent (c) | 0.34 ml/m$^2$ |
| Support: | |
| Polyethylene laminate paper (containing a white pigment ($TiO_2$) and a bluish dye (ultramarine) on the polyethylene layer adjacent to the first layer) | |

(k) Cyan Coupler

1/1 mixture (molar ratio) of the following two compounds

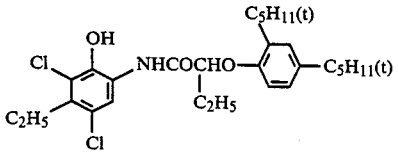

and

-continued

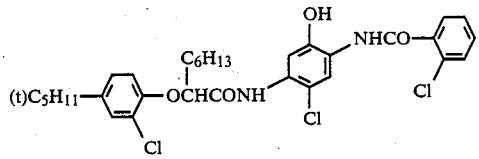

(l) Dye Image Stabilizer

1/3/3 mixture (molar ratio) of the following three compounds

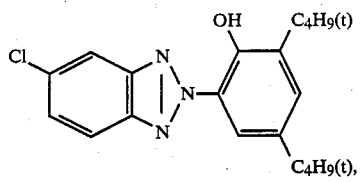

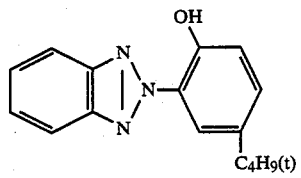

and

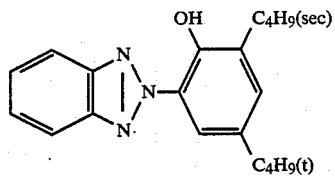

(m) Solvent

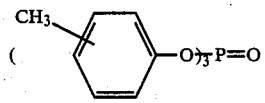

The multilayer color photographic papers thus prepared were imagewise exposed to light. The photographic papers thus exposed were then continuously processed in the following Processing Steps A and B until the developing solution was replenished three times the volume of the color developing tank.

Processing Step A:

| | |
|---|---|
| Color Development (33° C.) | 3 min 30 sec |
| Bleach-Fixing (33° C.) | 1 min 30 sec |
| Rinsing 1 (24 to 30° C.) | 1 min |
| Rinsing 2 (24 to 30° C.) | 1 min |
| Rinsing 3 (24 to 30° C.) | 1 min |
| Drying (80° C.) | 1 min |

Processing Step B:

| | |
|---|---|
| Color Development (36° C.) | 45 sec |
| Bleach-Fixing (36° C.) | 45 sec |
| Rinsing 1 (24 to 30° C.) | 30 sec |
| Rinsing 2 (24 to 30° C.) | 30 sec |
| Rinsing 3 (24 to 30° C.) | 30 sec |
| Drying (80° C.) | 1 min |

The rinsing step was carried out by a countercurrent flow from Rinsing Step 3 to Rinsing Step 1.

The color developing solutions and bleach-fixing solutions used in Processing Steps A and B had the following compositions:

Color Developing Solution:

| | Solution in tank | Solution to be replenished |
|---|---|---|
| Water | 800 ml | 800 ml |
| Diethylenetriaminepenta-acetic acid | 3.0 g | 3.0 g |
| Benzyl alcohol | As described in Table 2 | |
| Diethylene glycol | As described in Table 2 | |
| Sodium sulfite | 2.0 g | 2.3 g |
| Potassium bromide | 1.0 g | — |
| Potassium carbonate | 30.0 g | 30.0 g |
| Compound to be used in the present invention (as described in Table 1) | As described in Table 2 | |
| Sulfuric acid salt of N—ethyl-N—(β-methanesulfon-amidoethyl)-3-methyl-4-aminoaniline | 5.5 g | 7.5 g |
| Sulfuric acid salt of hydroxylamine | 3.0 g | 3.5 g |
| Brightening agent (stilbene) | 3.0 g | 1.5 g |
| Water to make | 1,000 ml | 1,000 ml |
| pH (adjusted with KOH) | 10.20 | 10.30 |

Bleach-Fixing Solution:

| | Solution in tank | Solution to be replenished |
|---|---|---|
| Water | 400 ml | 400 ml |
| Ammonium thiosulfate (70 wt %) | 150 ml | 300 ml |
| Sodium sulfite | 18 g | 36 g |
| Ammonium ethylenediamine-tetraacetate (III) | 55 g | 110 g |
| Ethylenediaminetetraacetic acid | 5 g | 10 g |
| Water to make | 1,000 ml | 1,000 ml |
| pH | 6.75 | 6.30 |

The amount of the color developing solution, the bleach-fixing solution, and water to be replenished were 160 ml, 100 ml, and 10 l per $m^2$ of photographic paper, respectively.

In Processing Steps A and B, the change in the stain density of yellow and magebta between the time when the unexposed portion of the above-mentioned photographic papers began to be processed and the time when the processing was completed was measured. The change in each stain density between the time when the processing began and the time when the continuous processing was completed is shown in Table 2.

TABLE 1

| Compound No. | Structural Formula |
|---|---|
| I | 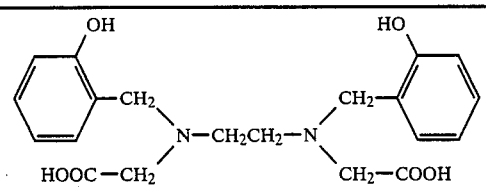 |
| II | 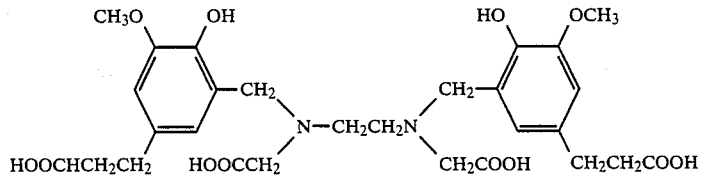 |
| III | 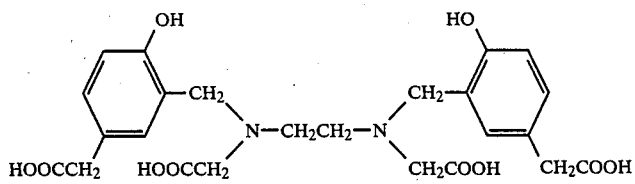 |

TABLE 2

| Sample No. | Processing Step | Benzyl Alcohol (ml/l) Tank Solution/ Solution to Be Replenished | Diethylene Glycol (ml/l) Tank Solution/ Solution to Be Replenished | Compound No. (g/l) Tank Solution/ Solution to Be Replenished | Stain Change after Processing* Yellow | Stain Change after Processing* Magenta |
|---|---|---|---|---|---|---|
| 1 (Comparison) | A | 15/19 | 10/10 | None | +0.02 | +0.01 |
| 2 (Comparison) | B | 15/19 | 10/10 | None | +0.15 | +0.10 |
| 3 (Comparison) | B | 15/19 | 10/10 | I 3/3 | +0.12 | +0.08 |
| 4 (Comparison) | B | 15/19 | 10/10 | II 3/3 | +0.12 | +0.08 |
| 5 (Comparison) | B | 15/19 | 10/10 | III 3/3 | +0.13 | +0.08 |
| 6 (Comparison) | B | None | None | None | +0.09 | +0.05 |
| 7 (Invention) | B | None | None | I 3/3 | +0.01 | ±0 |
| 8 (Invention) | B | None | None | II 3/3 | +0.02 | +0.01 |
| 9 (Invention) | B | None | None | III 3/3 | +0.02 | +0.01 |

*The stain after processing represents the change in each stain density between the time when the processing started and the time when the continuous processing was completed.

Table 2 shows that when the color development time is shortened, the yellow and magenta stain after processing becomes worse as compared to Processing Step A. If the compound of the present invention is used, the anti-stain property is slightly improved (Sample No. 2) but fails far short of that of Sample No. 1.

It is also shown that if benzyl alcohol is not used (Sample No. 6), the anti-stain property is improved as compared to that of Sample No. 2 even in Processing Step B. Furthermore, if the compound of the present invention is used, the anti-stain property is further improved (Sample Nos. 7 to 9).

EXAMPLE 2

Example 2 was conducted in the same manner as used in Example 1 except that the amount of rinsing water was 250 ml per $m^2$ of light-sensitive material and replenisher containing 0.5 g/l (water) of EDTA.2N was used as rinsing water to be replenished. The results are shown in Table 3.

TABLE 3

| Sample No. | Processing Step | Benzyl Alcohol (ml/l) Tank Solution/ Solution to Be Replenished | Diethylene Glycol (ml/l) Tank Solution/ Solution to Be Replenished | Compound No. (g/l) Tank Solution/ Solution to Be Replenished | Stain Change after Processing* Yellow | Stain Change after Processing* Magenta |
|---|---|---|---|---|---|---|
| 11 (Comparison) | A | 15/19 | 10/10 | None | +0.03 | +0.02 |
| 12 (Comparison) | B | 15/19 | 10/10 | None | +0.19 | +0.12 |
| 13 (Comparison) | B | 15/19 | 10/10 | I 3/3 | +0.16 | +0.10 |
| 14 (Comparison) | B | 15/19 | 10/10 | II | +0.17 | +0.10 |

TABLE 3-continued

| Sample No. | Processing Step | Benzyl Alcohol (ml/l) Tank Solution/ Solution to Be Replenished | Diethylene Glycol (ml/l) Tank Solution/ Solution to Be Replenished | Compound No. (g/l) Tank Solution/ Solution to Be Replenished | Stain Change after Processing* Yellow | Magenta |
|---|---|---|---|---|---|---|
| 15 (Comparison) | B | 15/19 | 10/10 | 3/3 III 3/3 | +0.16 | +0.10 |
| 16 (Comparison) | B | None | None | None | +0.15 | +0.09 |
| 17 (Invention) | B | None | None | I 3/3 | +0.02 | +0.01 |
| 18 (Invention) | B | None | None | II 3/3 | +0.02 | +0.02 |
| 19 (Invention) | B | None | None | III 3/3 | +0.03 | +0.02 |

*Stain change after processing is as defined in Table 2.

Table 3 shows that when the color development time is shortened, the yellow and magenta stain after processing becomes worse as compared with Processing Step A (Sample No. 12). If the compound of the present invention is used, the anti-stain property is slightly improved, but falls far short of that of Sample No. 11.

It is also shown that if benzyl alcohol is not used (Sample No. 16), the anti-stain property is improved as compared with that of Sample No. 12 even in Processing Step B. Furthermore, if the compound of the present invention is used, the anti-stain property is further improved (Sample Nos. 17 to 19).

EXAMPLE 3

A continuous processing was conducted with Compound I of the present invention in the same manner as used in Examples 1 and 2 except that the rinsing replenisher used in Example 2 was replaced by Rinsing Replenishers A to E. The stain change was then measured. As a result, a remarkable improvement in the anti-stain property was observed even in a rapid processing step only when the color developing solution free of benzyl alcohol comprising the present compound was used.

| | |
|---|---|
| Rinsing Replenisher Composition A: | |
| Sulfanylamide | 0.2 g/l |
| Rinsing Replenisher Composition B: | |
| Benzotriazole | 0.5 g/l |
| Rinsing Replenisher Composition C: | |
| Ethylenediamine-N,N,N',N'—tetra-methylenephosphonic acid | 0.5 g/l |
| pH (adjusted with KOH) | 7.0 |
| Rinsing Replenisher Composition D: | |
| 1-Hydroxyethylidene-1,1-diphosphonic acid | 1.6 ml |
| Bismuth chloride | 0.35 g |
| Polyvinyl pyrrolidone | 0.25 g |
| Ammonia water (26 wt %) | 2.5 ml |
| Trisodium nitrilotriacetate | 1.0 g |
| 5-Chloro-2-methyl-4-isothiazoline-3-one | 50 mg |
| 2-Octyl-4-isothiazoline-3-one | 50 mg |
| Brightening agent (4,4'-diamino-stilbene) | 1.0 g |
| Water to make | 1,000 ml |
| KOH to give | pH 7.5 |
| Rinsing Replenisher Composition E: | |
| 1-Hydroxyethylidene-1,1-diphosphonic acid (60 wt %) | 2.0 ml |
| Ammonium alum | 0.5 g |
| Sulfanylamide | 100 mg |
| Ammonia water (26 wt %) | 1.8 ml |
| Water to make | 1,000 ml |
| KOH to give | pH 7.5 |

While the invention has been described in detail and with reference to specific embodiments thereof, it will be apparent to one skilled in the art that various changes and modifications can be made therein without departing from the spirit and scope thereof.

What is claimed is:

1. A method for continuous processing silver halide color photographic material, which comprises processing a silver halide color photographic material having at least one silver halide emulsion layer on a reflective support with a color-developing solution containing benzyl alcohol in a concentration of 0.5 ml/l or less, and containing at least one compound represented by formula (I)

(I)

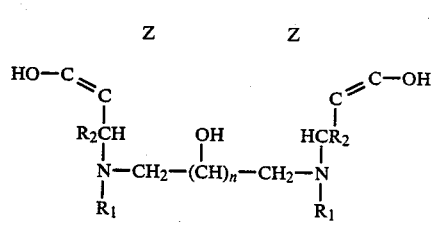

wherein $R_1$ represents a hydrogen atom, $—CH_2COOH$, or

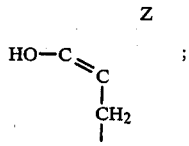

$R_2$ represents a hydrogen atom of —COOH: n represents an integer of 0 or 1; and Z represents atoms necessary for the formation of an aromatic ring; and subsequent to color-developing, bleach-fixing said material for a time of 1 minute or less and then rinsing said material for a time of 2 minutes or less.

2. A method for processing a silver halide color photographic material as in claim 1, wherein said color-developing solution contains an aromatic primary amine color-developing agent.

3. A method for processing a silver halide color photographic material as in claim 1, wherein the replenished amount of the rinsing solution per unit area of said silver halide color photographic material is from 0.1 to 50 times the amount of the solution which is carried from the preceding bath.

4. A method for processing a silver halide color photographic material as in claim 1, wherein said compound represented by formula (I) has a structure represented by formula (II)

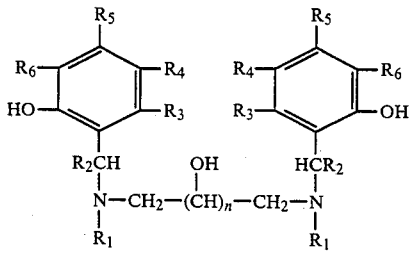

(II)

wherein $R_1$ represents a hydrogen atom, $—CH_2—COOH$, or

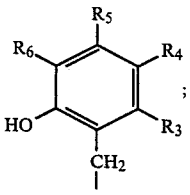

$R_2$ represents a hydrogen atom or —COOH; $R_3$, $R_4$, $R_5$ and $R_6$ eacch represents —COOH, $—SO_3H$, a substituted or unsubstituted $C_{1-4}$ alkyl or alkoxy group, or $R_3$ and $R_4$, or $R_4$ and $R_5$ form a condensed benzene ring, or $R_5$ and $R_6$ form a condensed benzene ring; n represents an integer of 0 or 1.

5. A method for processing a silver halide color photographic material as in claim 4, wherein said color-developing solution contains an aromatic primary amine color-developing agent.

6. A method for processing a silver halide color photographic material as in claim 4, wherein said silver halide color photographic material is subjected to bleach-fixing and then to rinsing after being color-developed, and said bleach-fixing time is 1 minute or less and said rinsing time is 2 minutes or less.

7. A method for processing a silver halide color photographic material as in claim 4, wherein the replenished amount of the rinsing solution per unit area of said silver halide color photographic material is from 0.1 to 50 times the amount of the solution which is carried from the preceding bath.

8. A method for processing a silver halide color photographic material as in claim 4, wherein $R_1$ is $—CH_2COOH$.

9. A method for processing a silver halide color photographic material as in claim 1, wherein said silver halide emulsion contains silver bromide, silver chlorobromide, or silver chloride each containing substantially no silver iodide.

10. A method for processing a silver halide color photographic material as in claim 1, wherein said silver halide emulsion contains silver chlorobromide containing from 2 to 98 mol% of silve chloride.

11. A method for processing a silver halide color photographic material as in claim 1, wherein said compound represented by formula (I) is at least one compound selected from N,N'-bis(2-hydroxybenzyl)ethylenediamine-N,N'-diacetic acid, N,N'-bis[3-(2-carboxyethyl)-6-hydroxy-5-methoxybenzyl]ethylenediamine-N,N'-diacetic acid, N,N'-bis(3-carboxymethyl-6-hydroxybenzyl)ethylenediamine-N,N'-diacetic acid, N,N'-bis(3,5-dimethyl-6-hydroxybenzyl)ethylenediamine-N,N'-diacetic acid, N,N'-ethylenebis(2-hydroxyphenylglycine), or N,N'-bis(3-sulfo-6-hydroxybenzyl)ethylenediamine-N,N'-diacetic acid.

12. A method for processing a silver halide color photographic material as in claim 1, wherein said compound represented by formula (I) is present in the color-developing solution in an amount of from 0.1 to 10 g/liter.

* * * * *